US007850342B2

(12) United States Patent
Abdelsamed

(10) Patent No.: US 7,850,342 B2
(45) Date of Patent: Dec. 14, 2010

(54) LUMINAIRE REFLECTOR WITH LIGHT-MODIFYING FLANGE

(75) Inventor: Yaser S. Abdelsamed, Granville, OH (US)

(73) Assignee: ABL IP Holding LLC, Conyers, GA (US)

( * ) Notice: Subject to any disclaimer, the term of this patent is extended or adjusted under 35 U.S.C. 154(b) by 638 days.

(21) Appl. No.: 10/593,954

(22) PCT Filed: Dec. 2, 2005

(86) PCT No.: PCT/US2005/043676

§ 371 (c)(1),
(2), (4) Date: Sep. 22, 2006

(87) PCT Pub. No.: WO2006/060682

PCT Pub. Date: Jun. 8, 2006

(65) Prior Publication Data

US 2009/0251784 A1 Oct. 8, 2009

Related U.S. Application Data

(60) Provisional application No. 60/632,665, filed on Dec. 3, 2004.

(51) Int. Cl.
*F21V 9/00* (2006.01)
*F21V 7/22* (2006.01)

(52) U.S. Cl. ..... 362/293; 362/300; 362/301; 362/308; 362/349

(58) Field of Classification Search ..... 362/296.01, 362/293, 297, 298, 299, 300, 307, 308, 346, 362/301; 359/831, 833, 837
See application file for complete search history.

(56) References Cited

U.S. PATENT DOCUMENTS

| | | | | |
|---|---|---|---|---|
| 5,036,445 | A * | 7/1991 | Osteen | 362/348 |
| 5,444,606 | A * | 8/1995 | Barnes et al. | 362/340 |
| 6,044,196 | A | 3/2000 | Winston et al. | |
| 6,337,946 | B1 | 1/2002 | McGaffigan | |
| 6,367,950 | B1 | 4/2002 | Yamada et al. | |
| 6,575,601 | B1 * | 6/2003 | Sitzema et al. | 362/340 |
| 2003/0156417 | A1 | 8/2003 | Gasquet et al. | |

FOREIGN PATENT DOCUMENTS

| | | |
|---|---|---|
| EP | 1 500 872 | 1/2005 |
| FR | 731324 | 9/1932 |

* cited by examiner

*Primary Examiner*—Thomas M Sember
(74) *Attorney, Agent, or Firm*—Clark & Brody

(57) ABSTRACT

A luminaire reflector of the type that is dome-shaped and includes a flange at the bottom provides a modified a flange that alters the pattern or other effect of light trapped in the wall of the reflector and exiting through the flange. When the bottom surface of the flange is angled with respect to the horizontal, the light exiting the flange is spread and lifted. In accordance with another embodiment, the flange is provided with a colored layer to provide decorative effects to the light exiting the flange.

12 Claims, 2 Drawing Sheets

LUMINAIRE REFLECTOR WITH LIGHT-MODIFYING FLANGE

This application is the national stage of International Application Number PCT/US2005/043676, filed Dec. 2, 2005, which was published in English, and claims priority of U.S. Provisional Application No. 60/632,665, filed Dec. 3, 2004.

TECHNICAL FIELD

This invention relates to the art of luminaires. In particular, the invention relates to a luminaire with a reflector having a plurality of prismatic reflectors that reflect incident light from a source onto an area to be illuminated.

BACKGROUND ART

Luminaires are known that comprise a series of generally vertical, right-angle prisms for reflecting light from a centrally located lamp. The reflectors for these luminaries are made with transparent material (glass, acrylic, etc.) and typically have sets of longitudinal prisms running from top to bottom. The reflector typically has a desired overall contour provided by the series of prisms. In most cases the desired overall contour is dome-like, with an upper part of smaller diameter and a lower part of larger diameter.

Reflectors of the type having a prescribed overall dome-like structure with a series of circumferentially spaced prismatic reflectors on the exterior surface are known. The prismatic reflectors are formed of two, preferably perpendicular, faces with the intersections of the faces aligned in generally longitudinal directions with respect to the longitudinal axis of the luminaire. The prismatic reflectors are arranged such that the light passing through the interior surface of the reflector strikes the outer surface at near the critical angle whereby the light is reflected toward the interior of the reflector at an angle that results in its exiting the reflector.

Such luminaires are typically configured such that a light source is supported near an upper end of the reflector, which is open at the lower end opposite the light source to form an exit aperture. The reflector wall generally terminates at the open end in a flange having a width slightly greater than the thickness of the wall of the reflector. This flange is typically formed by a planar bottom surface oriented perpendicular to the longitudinal axis of the reflector, which renders it horizontal when the luminaire is in use. An example of such a prior art luminaire is that shown in U.S. Pat. No. 5,036,445 (Osteen). As used herein, "flange" refers generally to the bottom part of the reflector that typically projects slightly from the outer surface of the reflector but includes also structures that form the bottom edge of the reflector without projecting beyond the outer surface.

A problem with the prior reflectors of this type is that the some of the light entering the reflector wall through the inner surface becomes trapped between the inner and outer walls. That is, some of the light that passes through the inner face of the reflector is reflected by the outer prism faces but is not then transmitted back through the inner surface because it is reflected from the inner surface. This light reflected at the reflector-air interface becomes trapped by repeated reflection between the outer prism faces and the inner surface, much as light is trapped in a waveguide. When this phenomenon is combined with the dome-shape of a typical reflector, the result is that the trapped light eventually travels down the sides of the luminaire at small angles with respect to the vertical (nadir), which are high angles of incidence with respect to the inner surface. The trapped light is ultimately incident on the bottom flange of the luminaire at a small angle of incidence and often passes directly through the flange with little change in direction, creating a bright annulus of light at angles near nadir.

In the general case, this annulus of light passing through the flange is unwanted. One reason the annulus is undesired is that it is very bright and, thus, contrasts with the remainder of the light distribution. The annulus is bright because the direction of the light is near nadir and does not distribute into the luminaire's light pattern. Instead, the light is concentrated into a small solid angle.

SUMMARY OF THE INVENTION

In accordance with the invention, the flange is configured to direct trapped light incident on a flange into desired directions or patterns. In one embodiment, the bottom face of the flange is beveled whereby the beveled part refracts the incident trapped light over a range of angles that moves it away from the nadir (i.e., raises it) and also spreads it out. This reduces the brightness of the light passing through the flange and makes it less noticeable. The beveled face may be planar or curved (e.g., an arc, ellipse, or parabola) or formed by a plurality of smaller line segments or by lenticular elements. As well, the flange may be provided with multiple prisms.

In accordance with a second embodiment of the invention, the light from the flange is modified in other ways to render it less objectionable or even decorative. For example, a color filter may be applied to the bottom of the flange to create a colored pattern of desired shape and brightness. And such a filter may be combined with the beveled or angled flange to provide the desired pattern. As well, the flange may be colored in other ways, such as by painting the flange or by coloring the flange material itself. Other optical features may also be added to provide a desired light pattern from the flange light.

It is an object of this invention to provide structure that modifies light trapped in a luminaire wall and incident on a flange of the luminaire by changing its color, intensity, or direction to result in a desired light pattern.

DETAILED DESCRIPTION OF THE PREFERRED EMBODIMENTS

Figure 1:
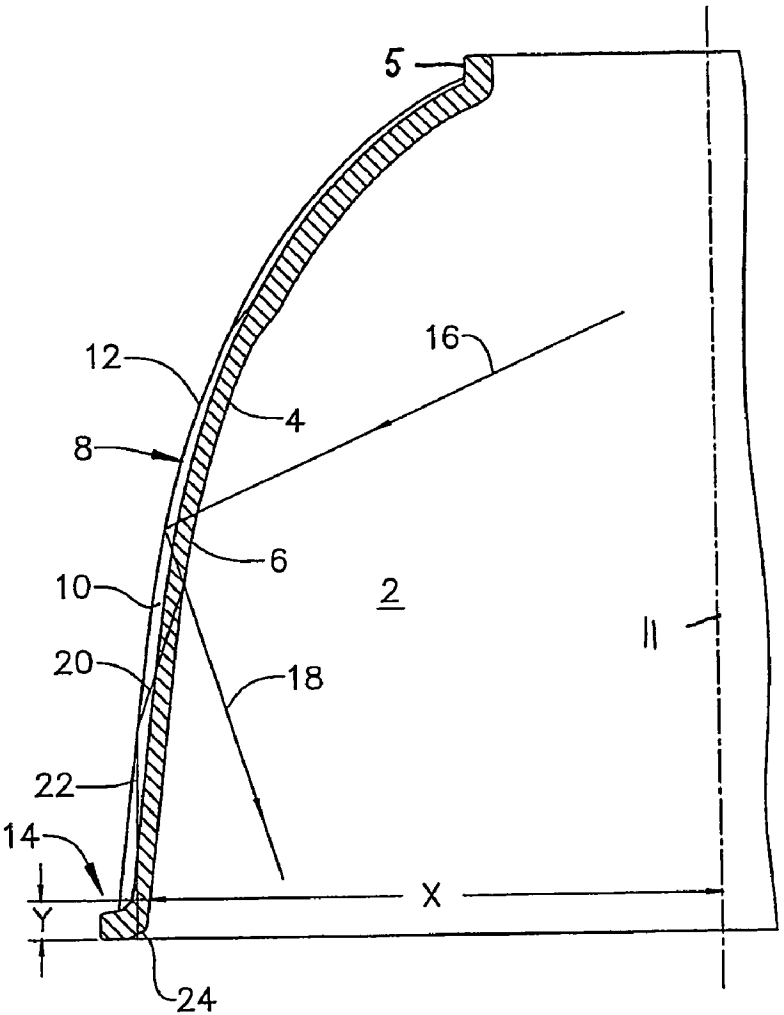
FIG. 1 is a partial vertical cross section of a luminaire reflector having a flange according to a first embodiment of the invention.

With reference to the drawing figures, FIG. 1 is a partial vertical cross section of a luminaire reflector 2 formed by a wall 4 of generally transparent material, such as glass or acrylic plastic. The reflector is configured to reflect light originating from a source (not shown) that is centrally located in the reflector as is known in the art. The inner surface 6 of the wall 4 is generally smoothly curved but may be provided with a more complex shape as is known in the art.

The reflector wall 4 is made reflective by providing a series of prisms 8 on the outer surface of the wall 4. The prisms are formed by faces 10 that extend longitudinally along the wall in a prescribed curve to form the outer surface of the wall.

Adjacent pairs of faces 10 form a dihedral angle of 90° and intersect at peaks 12. By this arrangement, light rays from the light source entering the wall from the central portion of the reflector are generally reflected by the prism faces 10 by total internal reflection, as is known in the art.

In the preferred embodiment, the wall 4 is rotationally symmetric about a longitudinal axis 11, and an upper end 5 is configured to engage structure for mounting the reflector such that the axis 11 is essentially vertical. The lower end of the reflector that will be at its bottom when the reflector is so mounted is formed by a flange 14 which will be described in detail below.

An illustrative light ray incident on the inner surface 6 of the wall 4 is shown at 16. Light ray 16 originates in a lamp (see FIG. 3), impinges on the wall 4 and is reflected by the faces 10 to form reflected ray 18, which exits the reflector through the opening (exit aperture) formed by the flange 14. However, when the reflected ray impinges on the surface 6, some of the light is reflected at the surface back toward the outer surface of the reflector. Such a ray is illustrated at 20.

The ray 20 is in turn reflected again by prism faces 10, which is illustrated by ray 22. It will be appreciated that in this manner light is trapped inside the wall 4 of the reflector and is reflected repeatedly at the inner surface 6 and the prism faces 10. It will further be appreciated that because of the overall dome shape of the reflector the lower portion of the wall 4 becomes more linear in cross section, whereby trapped light such as that illustrated by ray 22 will be incident on the flange 14 at a relatively small angle of incidence.

Prior art flanges, such as that shown in U.S. Pat. No. 5,036,445, are generally planar, which allows the trapped light to pass directly through the flange in a direction close to vertical (nadir). The trapped light passing through the flange in this manner forms a relatively bright annulus of light directed downward, which is undesirable because it contrasts with the light pattern created by the remainder of the reflector.

In accordance with the invention, the flange is provided with optical means that ameliorates the adverse effects of trapped light incident on the flange. In the embodiment shown in FIGS. 1 and 2, the flange is provided with an angled face 24 positioned to receive the incident trapped light rays 22. In the preferred embodiment, the wall 4 is rotationally symmetric about longitudinal axis 11, in which case face 24 takes the shape of a truncated cone. Of course, ray 22 is only illustrative, and other trapped rays will be incident on the face 24 at other locations on the face and at other angles of incidence.

Face 24 is preferably oriented such that the incident ray 22 is refracted to form ray 26. This refraction accomplishes two objectives. First, the refraction "lifts" the light passing through the flange by increasing its angular relationship with respect to nadir. Thus, refraction of the trapped rays by face 24 redirects that light to higher angles, which reduces objectionable effects of light at nadir. Second, by increasing the angle of the light, the light is spread out over a larger area, thus reducing its brightness and allowing it to merge with the other light from the reflector.

Figure 2:
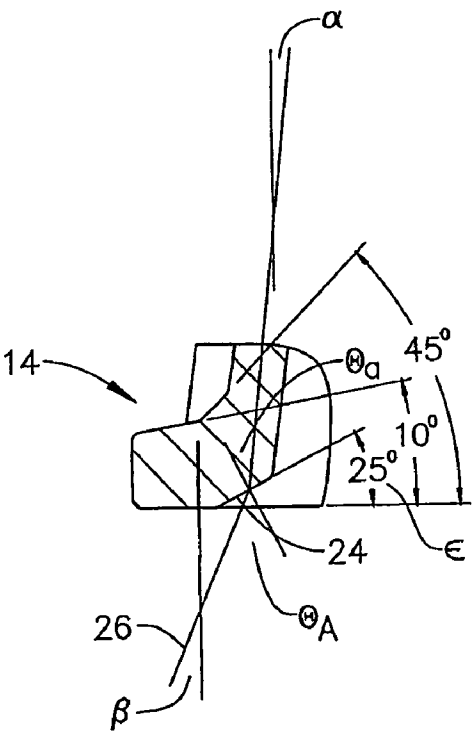
FIG. 2 is a partial vertical cross section of the flange of the reflector shown in FIG. 1.

With reference to FIG. 2, face 24 is shown oriented at an angle $\epsilon$, which is illustrated to be 25°, with respect to the horizontal. It will be appreciated that ray 22 forms an angle $\alpha$ with respect to the vertical and is incident on the face 24 at an angle of incidence $\theta_a$. The angle of incidence geometrically equals $\alpha+\epsilon$. Ray 22 will be refracted at face 24 as is known in the art to form refracted ray 26. Ray 26 will exit face 24 at angle of refraction $\theta_A$, and form an angle $\beta$ with respect to the vertical. If one considers the situation wherein the rays 22 are incident over a range of angles $0°<\alpha<15°$, the angles $\beta$ are:

TABLE I

| $\alpha$ | $\beta$ |
|---|---|
| 0° | 13.6° |
| 5° | 22.5° |
| 10° | 32.8° |
| 15° | 46.5° |

It is apparent from Table I that for a face angled at 25° to the horizontal a fifteen-degree range of angles of incidence in the trapped rays results in a thirty-three degree spread in the angles of the refracted rays. This indicates that the trapped light incident on the improved flange is both raised and spread. The face 24 may be oriented at an angle of 15 to 35 degrees with respect to the horizontal.

Figure 3:
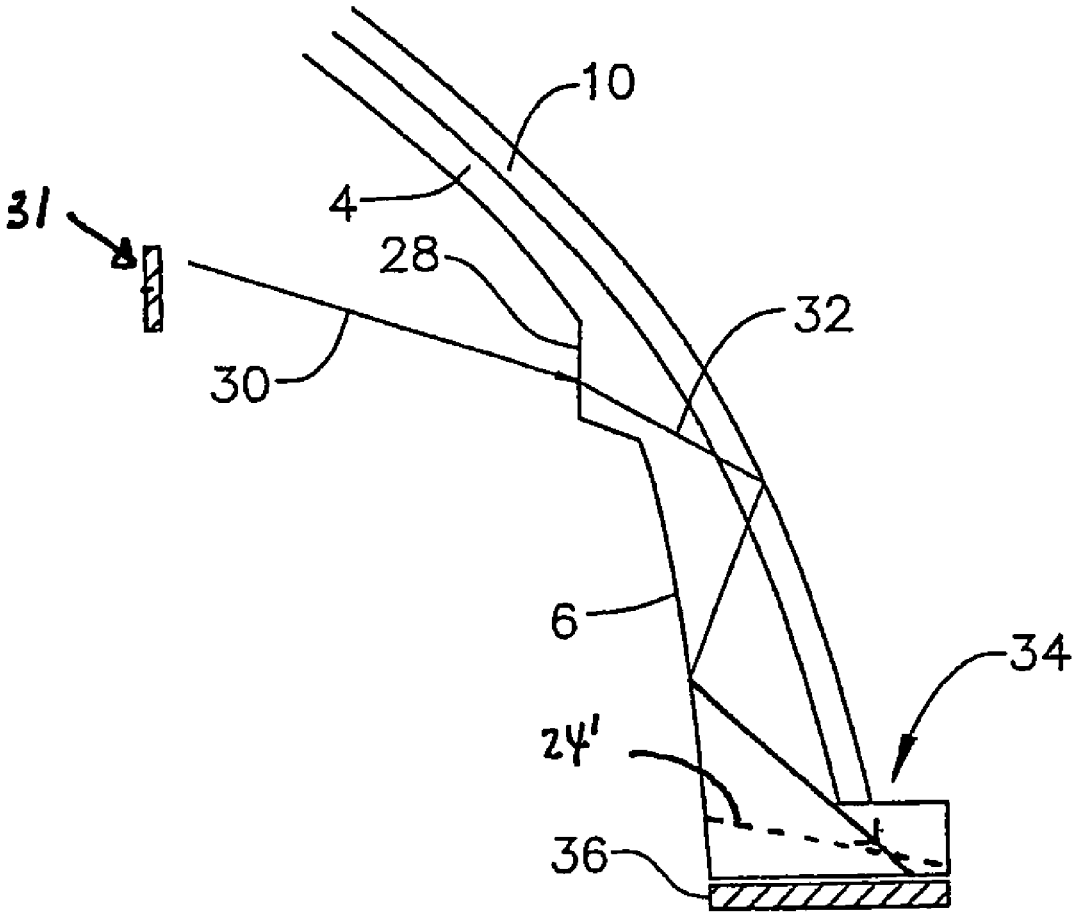
FIG. 3 is a vertical cross section showing a second embodiment of a reflector in accordance with the invention.

FIG. 3 illustrates another embodiment of the invention. According to the embodiment of FIG. 3, rays are intentionally introduced into the wall and trapped to provide increased light level to the flange. For example, the inner surface 6 of the wall 4 can be provided with a section 28 that forms an aperture for admitting rays 30 from a source such as that shown at 31 into the wall in a desired direction and intensity. These rays are trapped in the wall as shown at 32 and are eventually incident on the flange 34. Flange 34 may be planar as illustrated but may also have an angled face as shown in the embodiment of FIGS. 1 and 2 and illustrated by the dashed line 24' in FIG. 3. As well, flange 34 may have one or more faces configured to provide any desired optical effect; for example, flange 34 may have one or more curved faces, stepped faces, or prismatic faces illustrated at 24'.

In accordance with the embodiment of FIG. 3, flange 34 is provided with a colored filter 36 whereby light passing the flange is colored to provide a desired effect. This filter may take any of several forms, including a colored film attached to the flange, a film integral with the flange, a layer of paint, a diffraction grating, etc.

It will be appreciated that in accordance with the invention, a reflector is provided with means to control light trapped in the wall of the reflector and incident on a flange. Modifications within the scope of the appended claims will be apparent to those of skill in the art.

I claim:

1. A reflector comprising a shaped wall extending about a longitudinal axis and having opposed inner and outer surfaces, said wall having an upper end configured to engage structure for mounting the reflector such that said longitudinal axis is essentially vertical, a lower end below said upper end formed by a flange, and reflecting elements on said outer surface, said flange forming an exit aperture for light from a light source that passes through said inner surface into said wall and is reflected by said reflecting elements through said inner surface toward said exit aperture, said flange having incident thereon light trapped in said wall by reflection of some of said light at said inner surface back toward the outer surface after being reflected by said reflecting element, wherein said flange comprises an element that modifies the color or intensity of said trapped light, or refracts said trapped light away from said longitudinal axis.

2. A reflector according to claim 1 wherein said element comprises a colored filter.

3. A reflector according to claim 2 wherein said colored filter is a film attached to said shaped wall.

4. A reflector according to claim 1 wherein said element includes a layer of paint.

5. A reflector according to claim 1 wherein said element is further configured to receive light rays in said wall as incident light and to refract said light rays away from said longitudinal axis.

6. A reflector according to claim 5 wherein said at least part of said flange is a refracting planar face oriented at a non-zero angle with respect to the horizontal.

7. A reflector according to claim 6 wherein said non-zero angle is from about 15 to about 35 degrees.

8. A reflector according to claim 7 wherein said non-zero angle is about 25 degrees.

9. A reflector according to claim 5 wherein said element a curved face.

10. A reflector according to claim 5 wherein said element comprises a stepped face.

11. A reflector according to claim 1 further comprising an aperture in said inner surface for admitting a desired amount of light to said wall.

12. A reflector according to claim 11 wherein said aperture comprises a portion of said wall oriented with respect to the adjacent inner surface to direct rays into said wall.

* * * * *